US009216871B2

(12) United States Patent
Schnabel et al.

(10) Patent No.: US 9,216,871 B2
(45) Date of Patent: Dec. 22, 2015

(54) METHOD FOR REGISTER CORRECTION IN A WEB PROCESSING MACHINE HAVING A DELAY SECTION

(71) Applicant: Robert Bosch GmbH, Stuttgart (DE)

(72) Inventors: Holger Schnabel, Wuerzburg (DE); Stephan Schultze, Lohr-Wombach (DE); Mario Goeb, Wuerzburg (DE)

(73) Assignee: Robert Bosch GmbH, Stuttgart (DE)

( * ) Notice: Subject to any disclaimer, the term of this patent is extended or adjusted under 35 U.S.C. 154(b) by 248 days.

(21) Appl. No.: 13/762,713

(22) Filed: Feb. 8, 2013

(65) Prior Publication Data

US 2013/0206808 A1 Aug. 15, 2013

(30) Foreign Application Priority Data

Feb. 10, 2012 (DE) ..... 10 2012 002 675

(51) Int. Cl.

| | |
|---|---|
| ***B41F 13/54*** | (2006.01) |
| ***B65H 23/04*** | (2006.01) |
| ***B65H 23/188*** | (2006.01) |

(52) U.S. Cl.

CPC ..... *B65H 23/04* (2013.01); *B65H 23/1882* (2013.01); *B65H 2513/11* (2013.01); *B65H 2513/50* (2013.01); *B65H 2515/31* (2013.01); *B65H 2801/21* (2013.01)

(58) Field of Classification Search

CPC ..... B41F 13/02; B41F 13/03; B41F 13/04; B41F 13/18; B65H 23/04; B65H 23/1882; B65H 2513/11; B65H 2513/50; B65H 2513/31

USPC ..... 101/228, 220, 229, 481, 486, 92, 175, 101/176; 226/195, 131, 24, 27, 28, 29, 43

See application file for complete search history.

(56) References Cited

FOREIGN PATENT DOCUMENTS

| | | | |
|---|---|---|---|
| DE | 195 27 199 | A1 | 1/1997 |
| DE | 10 2008 053 406 | A1 | 4/2010 |
| DE | 10 2008 056 132 | A1 | 5/2010 |
| EP | 0 882 588 | A1 | 12/1998 |
| EP | 1 803 565 | A1 | 7/2007 |

OTHER PUBLICATIONS

German Search Report corresponding to DE Application No. DE 10 2012 002 675.7, dated Jan. 17, 2013 (German language document) (5 pages).

*Primary Examiner* — Matthew G Marini

(74) *Attorney, Agent, or Firm* — Maginot, Moore & Beck LLP

(57) ABSTRACT

A method for register correction in a web processing machine includes leading a product web through at least one delay section and processing the product web by a first processing device. An actuating command is applied to the first processing device to position the product web at an intended position during a web tension change. The actuating command is determined from an actuating command leading to the web tension change and at least one delay term. The at least one delay term delays the action of the actuating command leading to the web tension change on the actuating command for the first processing device by a delay time needed by the product web to pass through the at least one delay section before the first processing device.

14 Claims, 2 Drawing Sheets

METHOD FOR REGISTER CORRECTION IN A WEB PROCESSING MACHINE HAVING A DELAY SECTION

This application claims priority under 35 U.S.C. §119 to patent application no. DE 10 2012 002 675.7, filed on Feb. 10, 2012 in Germany, the disclosure of which is incorporated herein by reference in its entirety.

BACKGROUND

The present disclosure relates to a method for register correction in a web processing machine having a delay section.

Although reference is primarily made below to web-fed rotary printing presses of central cylinder design, the disclosure is not restricted thereto but instead is aimed at all types of processing machines in which a product web or material web runs through a delay section. A delay section in the sense of the disclosure is a section in the machine which forwards an incoming web tension change only with a time delay. The incoming web tension is not changed but substantially transported through unchanged, so that the web tension after the running time (therefore with the time delay) appears after the delay section. A delay section is formed, for example, when the product web wraps around one or more rolls, such as central cylinders, cooling or drying rolls, the web draw approximately not changing as a result of the web clinging to the roll during the roll contact. The time delay is also designated dead time.

Web-fed rotary printing presses of central cylinder design are particularly widespread in the area of flexographic printing but are also known, for example, in offset printing or digital printing. The central cylinder is also designated a common impression (CI) cylinder.

The central cylinder design is distinguished by the fact that the product web wraps around the central cylinder, the tensile force in the product web (web draw) approximately not changing as a result of the web clinging to the cylinder during the contact. As a result, known decoupling strategies which counteract the automatic production of a longitudinal register error or color register error (deviation of the actual position of the product (e.g. color separation) from the intended position) as a result of another actuating action (e.g. a longitudinal register correction or web draw correction) by means of specifically driving the processing device producing the relevant product cannot be applied. (A register error arises in web processing machines as a result of an actuating action when the actuating action leads to a change in the web tension. This is because the web tension change is then propagated through the machine and in the process leads to register errors.)

It is therefore desirable, even for these cases, to have a possible way of avoiding longitudinal register errors as a result of actuating movements or at least to keep the said errors small.

SUMMARY

A method for register correction having the features of the disclosure is proposed. Advantageous refinements are the subject matter of the sub-claims and of the following description.

The disclosure proposes a possible way of avoiding a longitudinal register error of a first processing device which, in web processing machines, conventionally occurs as a result of actuating actions (in particular longitudinal register corrections or web tension corrections) leading to web tension changes, even in the cases in which the processing point of the first processing device is located after a delay section, in particular on or after a central cylinder. As explained, a longitudinal register error means a deviation of the actual position of the product (e.g. color separation) of the first processing device from an intended position. The intended position can in particular be predefined by a product from a second processing device or else by particular features of the product web. By means of the solution according to the disclosure, a reduction in rejects (waste) can be achieved by improved maintenance of the register accuracy.

Within the context of the disclosure, account is taken of the fact that a web tension change running into the delay section (e.g. central cylinder) manifests itself on the first web processing device only after a time delay. Within the delay section, the web tension is not changed, which means that a product web cross section substantially maintains in the delay section the web tension with which it has run into the delay section.

A delay section is formed, for example, when the product web wraps around one or more rolls, such as central cylinders, but also cooling or drying rolls, the web draw approximately not changing as a result of the web clinging to the roll during the roll contact. Wrapped rolls are normally also relatively large, so that, even beginning with a wrap of about 5%, the effects on the web tension behavior are so great that the disclosure leads to noticeable advantages. The greater the level of wrap, the more clearly the advantage of decoupling according to the disclosure becomes. Beginning with a wrap of 25%, no more decoupling can normally be brought about by using conventional means. Here, the disclosure is then particularly advantageous. A delay section can also be formed by a plurality of rolls one after another, for example for drying. These rolls are often driven synchronously and together form a delay section.

It should be emphasized that different web tensions can also be present along a delay section, by the web tension varying at the entry point. An incoming web tension change can also be brought about in particular by a change in the speed of rotation of a central cylinder itself forming the delay section if the speed of rotation of the clamping point preceding the central cylinder does not change identically. In other words, a solution is also presented for avoiding register errors as a result of changes in the speed of rotation of the central cylinder.

The disclosure indicates a solution in order to take into account such transport delays (dead times) in the control or in decoupling (feedforward control). Within the context of the disclosure, the time delays proportional to the delay times are used in driving the first processing device and/or the central cylinder. The associated actuating commands (driving commands) can be determined on the basis of an actuating command which leads to a web tension change (for example speed change of the central cylinder). The disclosure is advantageously implemented in the context of feed-forward control (i.e. control in an open control loop). Since control in the closed control loop can only react to disturbances, a register error must first occur before it can be controlled out. Feedforward control, on the other hand, makes it possible that a longitudinal register error does not occur at all in the event of a web tension change. For this purpose, the first processing device has applied to it an actuating command which counteracts the occurrence of a longitudinal register deviation. The feedforward control can be integrated in a simple manner into existing control, for example register control or web tension control.

If the intended position is defined by the product from a second processing device, the latter is located upstream of the first processing device. The delay time is determined by one or more delay sections located in between. If the first processing device is located on a central cylinder, the second processing device can be located on the same central cylinder or further upstream. If the said second processing device is located on the same central cylinder, the delay time is determined by the distance between the first processing device and the second processing device along the central cylinder (circular arc length) and the tangential speed ($\omega_r$) of the central cylinder. If the said second processing device is located before the central cylinder, the delay time is determined by the position of the second processing device along the central cylinder (circular arc length) and the tangential speed ($\omega_r$) of the central cylinder and possibly further delay sections between the first processing device and the second processing device.

The delay time is preferably adapted during operation to the instantaneous tangential speed.

Normally, an actuating command leading to a web tension change (e.g. speed change for the central cylinder) is determined from a control output value within the context of register and/or draw control, for example by a PI controller. Within the context of the disclosure, the first processing device then has applied to it this control output value delayed appropriately in time (by means of a time delay element, in particular a dead time element, an approximation to a dead time element (e.g. Padé) or a $PT_1, \ldots, PT_n$ element) for the purpose of decoupling, the time delay being proportional to the delay time. If the delay section is formed by a central cylinder, the actuating command can also be applied to the central cylinder instead of or in addition to the first processing device, since only the relationship between product web (i.e. central cylinder movement) and processing device is decisive. In this way, in particular identical adjustments of a plurality of processing devices on a central cylinder can be carried out jointly by adjusting the central cylinder speed. This embodiment also makes it possible to operate a specific processing device on a central cylinder always at a constant speed, in that the actuating commands thereof are given to the central cylinder (if appropriate inversely or reciprocally).

A computing unit according to the disclosure, for example a control device of a press, is equipped, in particular by programming, to carry out a method according to the disclosure.

In addition, the implementation of the disclosure in the form of software is advantageous, since this permits particularly low costs, in particular if an executing computing unit is also used for further tasks and is therefore present in any case. Suitable data storage media for providing the computer program are in particular floppy disks, hard drives, flash memories, EEPROMs, CD-ROMs, DVDs and many more. A download of a program via computer networks (Internet, intranet and so on) is also possible.

Further advantages and refinements of the disclosure can be gathered from the description and the appended drawing.

It goes without saying that the features mentioned above and those still to be explained below can be used not only in the respectively specified combination but also in other combinations or on their own without departing from the scope of the present disclosure.

BRIEF DESCRIPTION OF THE DRAWINGS

The disclosure is illustrated schematically in the drawings by using exemplary embodiments and will be described extensively below with reference to the drawings.

DETAILED DESCRIPTION

Figure 1:
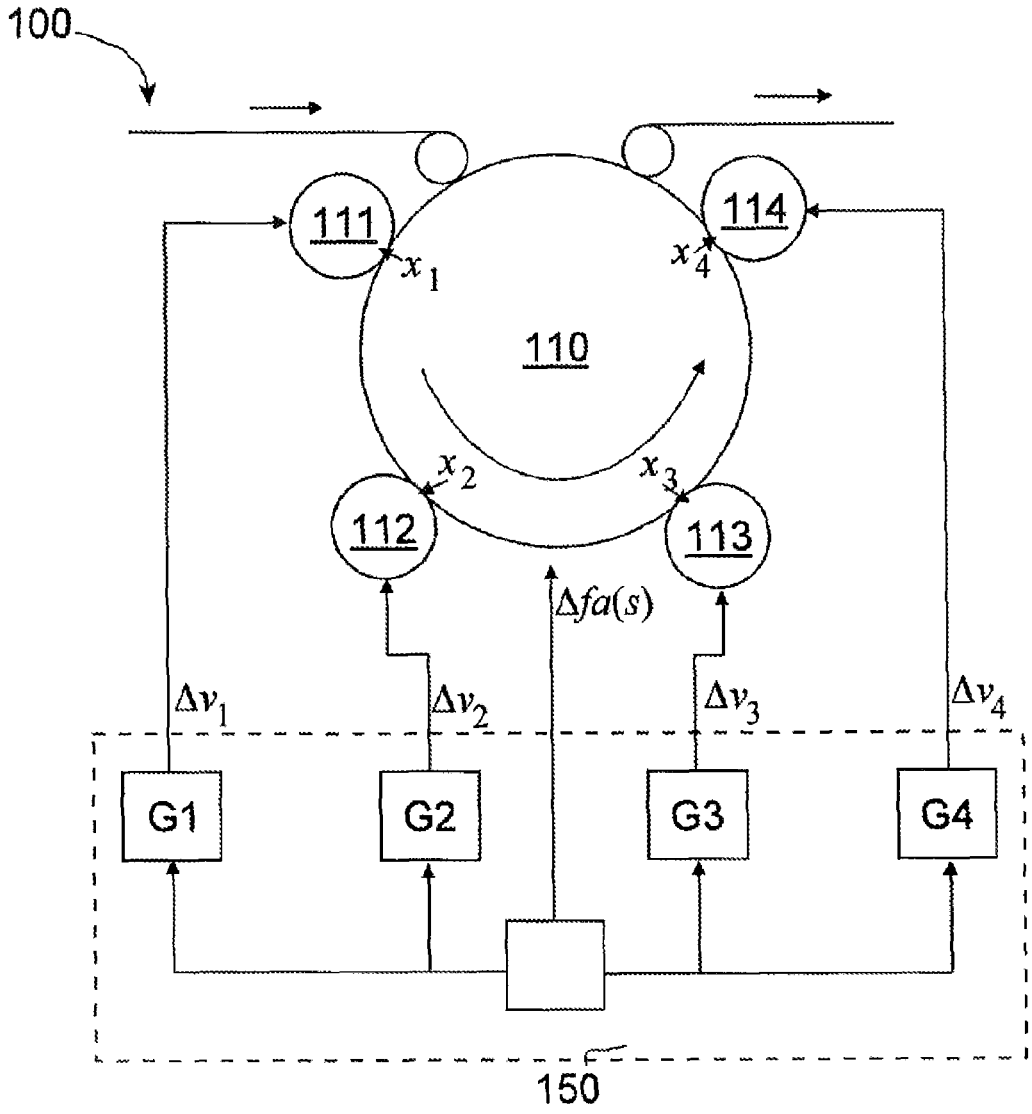
FIG. 1 shows an implementation of the disclosure by using a first press of central cylinder design.

A detail of a first web processing machine of central cylinder design, which can be operated in accordance with the disclosure, is illustrated in a schematic side view in FIG. 1. The web processing machine is constructed as a flexographic press 100 having a central cylinder 110 and four satellite printing units 111 to 114, as they are known, in which a product web, for example made of paper, is printed. For this purpose, the product web moves from left to right in the figure and is led around the central cylinder 110 in the counterclockwise direction. It is usual for color separations of different colors to be printed on by the satellite printing units 111 to 114 as products. The processing points of the printing units 111 to 114 are located on the central cylinder 110, as can be seen. They are designated by $x_1$ to $x_4$. Flexographic presses of this type are used, for example, in printing packaging.

The position of the individual color separations of the printing units on the product web 101 can be changed by applying an actuating command appropriately to the respective printing unit. The actuating command can, for example, change the speed of rotation and/or the angular position of the satellite printing unit for this purpose. This is sufficiently well known in the prior art. The actuating commands are illustrated here by $\Delta v_i$.

For the generation of these actuating commands, a computing unit 150 is provided, which is equipped by programming to carry out a method according to the disclosure. Within the computing unit, elements G1 to G4, which generate the respective control command from an input variable, are illustrated schematically. These elements are likewise implemented by programming.

It can be seen that, as a result of a change in the speed of rotation of the central cylinder 110, a change in the stretch in the product web is caused. If, for example, the speed of rotation of the central cylinder is increased, the stretch and therefore the web tension in the product web immediately before the central cylinder is also increased. This web tension increase is then conveyed into the central cylinder and, following a revolution, is visible after the central cylinder (in the event of a wrap of, for example, 75%, the web tension change would be visible after the central cylinder after ¾ of a revolution). During the revolution, the web tension changes at the points $x_1$ to $x_4$, which, without any further intervention from outside, leads to the color separations of the printing units 111 to 114 being displaced relative to one another. After the web tension has again reached a steady state, i.e. no longer changes over the periphery of the central cylinder, the register errors also automatically disappear (what is known as self-compensation). However, the register errors during the non-steady state should also be avoided. For this purpose, that printing unit of which the register error is to be avoided (i.e. the first printing unit in the sense of the disclosure) is driven in a particular way, as will be explained below within the context of an exemplary embodiment.

In the present example, it is to be assumed that what is known as standard color control is carried out, in which the intended position of the color separations of the printing units 112 to 114 is predefined by the color separation of the printing unit 111 (i.e. the second printing unit in the sense of the disclosure). In the case of precursor color control, the intended position of the color separation of a printing unit would be predefined respectively by the color separation of the previous printing unit.

The length of the delay section that is decisive for each printing unit is accordingly predefined by the circular arc lengths between the printing unit 111 and the respective printing unit, i.e. $x_2$-$x_1$, $x_3$-$x_1$ and $x_4$-$x_1$. The tangential speed of the product web v is defined by the speed of rotation of the central cylinder 110. The decisive delay times by which the corrective actuating command must be delayed are therefore determined from the relationship between the lengths just mentioned and the tangential speed just mentioned.

In the case of the standard color control, register errors can occur between 111 and 112, 111 and 113 and 111 and 114. Assuming a change in the speed of rotation of the central cylinder, the printing units 112-114 are corrected within the context of feedforward control such that, despite a change in the speed of rotation, no register errors occur. To this end, the delay time between the printing units is taken into account in the feedforward control. At the same time as the actuating command Δfa(s) (e.g. fine compensation=change in speed) is output to the central cylinder, actuating commands are output via the elements G1 to G4.

In the case of standard color control, G1=0. The elements G2 to G4 delay the action of the actuating command by the respective time delay $(x_i-x_1)/v$. If this is implemented in control terms as a dead time element, the result, for example, for the actuating command (e.g. a change in speed $\Delta v_2$) to the printing unit 112 is:

$$\Delta v_2(s) = v \cdot \left(1 - e^{-\frac{x_2 - x_1}{v} \cdot s}\right) \cdot \Delta fa(s).$$

$\Delta v_3$ and $\Delta v_4$ are calculated mutatis mutandis.

Instead of the change in speed described here as an actuating command, other actuating commands are also possible, in particular position (angular position).

The delay can be approximated by means of a dead time element, PTn element (n=1, 2, 3, . . . ) or Padé.

Figure 2:
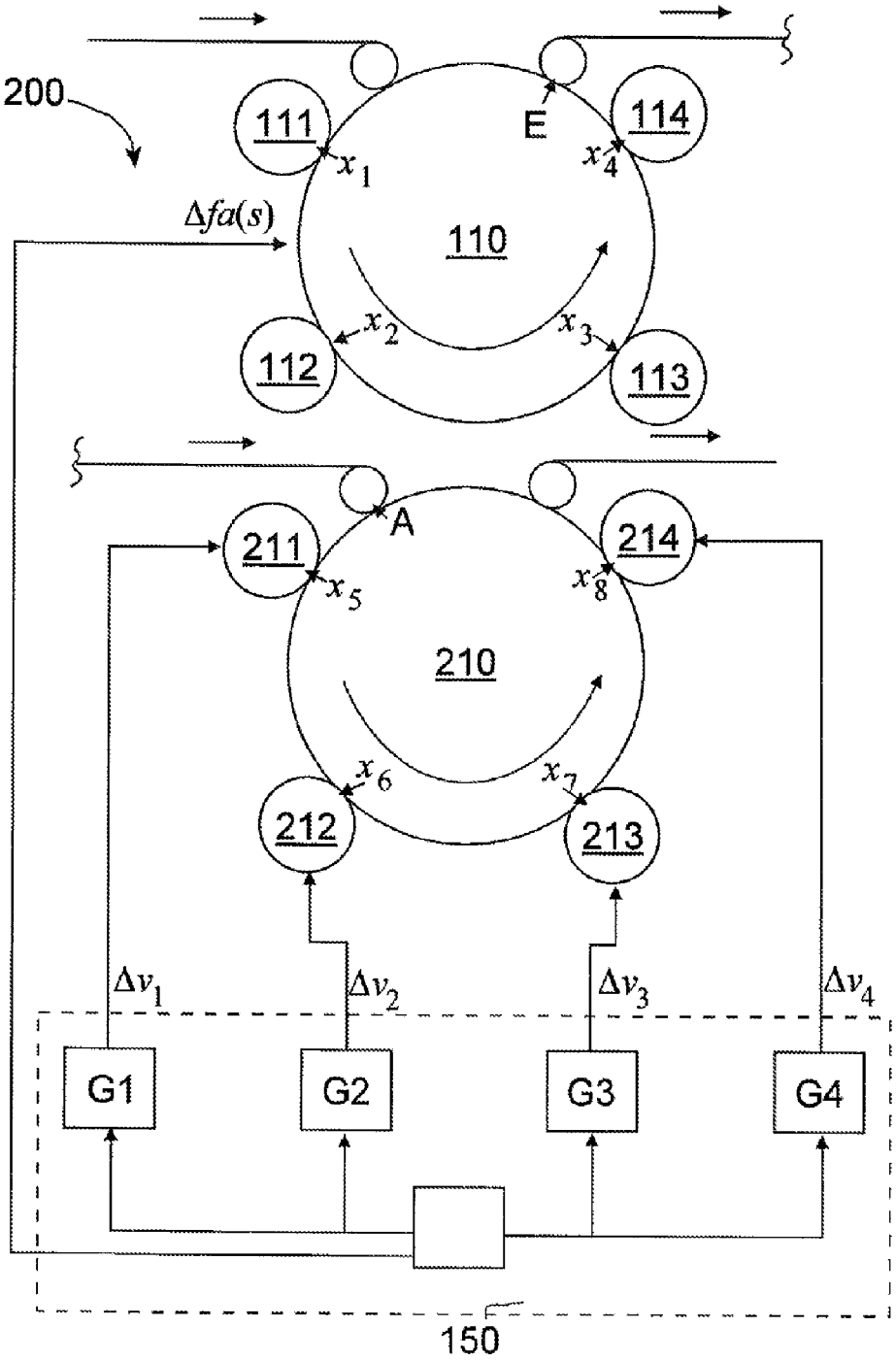
FIG. 2 shows an implementation of the disclosure by using a second press of central cylinder design.

A further implementation of the disclosure is illustrated in FIG. 2 by using a flexographic press having two central cylinders 110, 210. Once more, four satellite printing units 111 to 114 and 211 to 214 are arranged on each of the central cylinders. The product web runs firstly around the central cylinder 110 having the printing units 111 to 114 and then around the central cylinder 210 having the printing units 211 to 214. The guidance of the product web between the cylinders is not illustrated.

In the following text, it will be described by way of example how the standard color control from FIG. 1 can be expanded to the printing units 211 to 214. (The driving of the printing units 112-114 is identical to FIG. 1.) To this end, the delay times decisive for the printing units 211 to 214, which are composed of two parts, are determined. In the case of the central cylinder 110, the circular arc length between $x_1$ and E is decisive and, in the case of the central cylinder 210, the circular arc length between A and the processing point $x_j$ of the respective printing unit is decisive.

Between the two delay sections (central cylinders 110 and 210), the web tension change is transported in a known way, which can be taken into account, for example, by means of a correction term having a proportional response with time delay (PTn, e.g. PT1). For this purpose, there already exists a number of publications by the applicant; reference should be made, purely by way of example, to DE 10 2008 056 132 A1.

The web transport between the two central cylinders 110 and 210 is preferably taken into account by an additional PT1 element in the feedforward control, the time constant of which is predefined by T1=length/speed=(A–E)/v.

What is claimed is:

1. A method for register correction in a web processing machine, comprising:

leading a product web through at least one delay section including a first processing device;

determining an actuating command for the first processing device to position the product web from the first processing device at an intended position during a web tension change; and determining at least one delay term for the actuating command, the at least one delay term being based on a web tension change that is to result from an action associated with the actuating command; and applying the actuating command to the first processing device with a time delay based on the at least one delay term, wherein the time delay is configured to delay the action of the actuating command leading to the web tension change by a delay time needed for the product web to pass through the at least one delay section before the first processing device.

2. The method according to claim 1, wherein the at least one delay section contains at least one roll of which at least 5% is wrapped around by the product web.

3. The method according to claim 2, wherein the at least one roll is a central cylinder.

4. The method according to claim 3, wherein a processing point of the first processing device is located on the central cylinder.

5. The method according to claim 3, wherein the actuating command leading to the web tension change is an actuating command for the central cylinder.

6. The method according to claims 3, wherein the actuating command is applied to the central cylinder instead of or in addition to the first processing device.

7. The method according to claim 1, wherein the intended position is predefined by a second processing device.

8. The method according to claim 1, wherein the delay term is formed in control terms by a dead time element or proportional element with time delay or an element according to a Fade approximation.

9. The method according to claim 1, wherein the delay time is determined as the ratio of a length of the at least one delay section and a speed of the product web in the delay section.

10. The method according to claim 1, wherein the at least one delay section contains a plurality of rolls of which at least 5% is respectively wrapped around by the product web.

11. The method according to claim 1, wherein the actuating command is further determined by using a correction term, the correction term causing a proportional response with delay.

12. The method according to claim 11, wherein the proportional response with delay is a PT1 response.

13. A non-transitory computer program product having program code configured to cause a computer or a corresponding computing unit to implement a method for register correction in a web processing machine when the code is executed on the computer or the corresponding computing unit, the method including:

leading a product web through at least one delay section including a first processing device;

determining an actuating command for the first processing device to position the product web from the first processing device at an intended position during a web tension change; and determining at least one delay term for the actuating command, the at least one delay term being based on a web tension change that is to result from an action associated with the actuating command; and applying the actuating command to the first processing device with a time delay based on the at least one delay term, wherein the time delay is configured to delay the action of the actuating command leading to the web tension change by a delay time needed for the product web to pass through the at least one delay section before the first processing device.

14. The computer program according to claim 13, wherein the computer program is stored on a machine-readable storage medium.

* * * * *